US007499018B2

(12) United States Patent
Hung et al.

(10) Patent No.: US 7,499,018 B2
(45) Date of Patent: Mar. 3, 2009

(54) CONTROLLER, CONTROL METHOD, AND DISPLAY DEVICE UTILIZING THE SAME

(75) Inventors: Chi-Mao Hung, Chiayi (TW); Wei-Min Sun, Taipei (TW)

(73) Assignee: Au Optronics Corp., Hsinchu (TW)

( * ) Notice: Subject to any disclaimer, the term of this patent is extended or adjusted under 35 U.S.C. 154(b) by 659 days.

(21) Appl. No.: 11/142,692

(22) Filed: Jun. 1, 2005

(65) Prior Publication Data

US 2006/0109235 A1 May 25, 2006

(30) Foreign Application Priority Data

Nov. 25, 2004 (TW) ..... 93136272 A

(51) Int. Cl.
*G09G 3/36* (2006.01)

(52) U.S. Cl. ..... 345/103; 345/99; 345/104

(58) Field of Classification Search ..... 345/87–104, 345/204–215, 690–699
See application file for complete search history.

(56) References Cited

U.S. PATENT DOCUMENTS 6,556,181 B2 * 4/2003 Yamada et al. ..... 345/88
6,831,621 B2 * 12/2004 Nakano ..... 345/87
2002/0113764 A1 * 8/2002 Yamada et al. ..... 345/88
2003/0020677 A1 * 1/2003 Nakano ..... 345/87

FOREIGN PATENT DOCUMENTS

JP 09009180 1/1997

OTHER PUBLICATIONS

CN Office Action mailed May 25, 2007.

* cited by examiner

*Primary Examiner*—Vijay Shankar
(74) *Attorney, Agent, or Firm*—Thomas, Kayden, Horstemeyer & Risley

(57) ABSTRACT

A controller switching a display mode of a display panel. A processor provides a first initial signal and switches to a first display mode when a select signal is asserted. A gate driver simultaneously activates the gate electrodes in a first gate electrode group when receiving the first initial signal, sequentially activates the gate electrodes in a second gate electrode group when the first gate electrode group is activated, and simultaneously activates the gate electrodes in a third gate electrode group when the second gate electrode group is activated. A data driver provides corresponding image data to a data electrode depending on the activated gate electrodes when the first, second, or third gate electrode group is activated.

14 Claims, 6 Drawing Sheets

CONTROLLER, CONTROL METHOD, AND DISPLAY DEVICE UTILIZING THE SAME

BACKGROUND

The disclosure relates to a display device, and more particularly to a display device having different display modes.

FIG. 1*a* is a schematic diagram of a conventional display panel. Display panels generally have an aspect ratio of 4:3, consistent with television standards, such as those of the national television system committee (NTSC) or phase alternating line (PAL). In recent years, HDTV (High-Definition Television) systems using an aspect ratio of 16:9, as shown in FIG. 1*b*, have been widely adopted.

However, HDTV display devices are more expensive than conventional display devices with aspect ratio of 4:3. Many conventional methods are utilized to display a 16:9 image on a 4:3 panel. FIG. 1*c* shows a schematic diagram of a conventional display result. A 16:9 image is displayed in the center display region 14 of a panel. Display regions 12 and 16 are black. Non-display regions 10*a* and 10*b* fulfil no display function, thus the drivers of the panel can be disposed thereon.

Generally panels comprise formed by interlacing data electrodes and gate electrodes. Each interlacing data electrode and gate electrode controls a display unit. A controller controls a display unit according to corresponding data and gate electrodes. Non-display regions 10*a* and 10*b* also comprise gate electrodes. However, non-display regions 10*a* and 10*b* cannot display images, and thus comprise no the corresponding display units.

FIGS. 2*a* and 2*b* are timing charts of operation of a conventional driver. Drivers shown respectively output vertical clock signals $CKV_{(4:3)}$ and $CKV_{(16:9)}$. Image data is output from output terminals $Data_{(4:3)}$ or $Data_{(16:9)}$ of the driver.

As shown in FIG. 2*a*, when a 4:3 panel displays a 4:3 image, the driver outputs a vertical clock signal $CKV_{(4:3)}$ to activate gate electrodes in the panel. As shown in FIG. 1*c*, the gate electrodes in non-display region 10*a* are sequentially activated during period $t_1$. Since non-display region 10*a* cannot display images, output terminals $Data_{(16:9)}$ do not provide image data thereto.

During period $t_2$, the gate electrodes in display regions 12, 14, and 16 are sequentially activated. Since the display regions 12, 14, and 16 display images, the output terminals $Data_{(16:9)}$ provide normal image data n thereto.

During period $t_3$, gate electrodes in non-display region 10*b* are activated. Since non-display region 10*a* cannot display image, the output terminals $Data_{(16:9)}$ do not provide image data thereto.

As shown in FIG. 2*b*, when a 4:3 panel displays a 16:9 image, the gate electrodes in non-display region 10*a* are activated by the vertical clock signal $CKV_{(16:9)}$ during period $t_4$. Since non-display region 10*a* cannot display images, output terminals $Data_{(16:9)}$ do not provide image data thereto.

During period $t_5$, the gate electrodes in display region 12 are activated. The output terminal $Data_{(16:9)}$ provides black image data b thereto.

During period $t_6$, the gate electrodes in display region 14 are activated and the output terminals $Data_{(16:9)}$ provide normal image data n thereto.

During period $t_7$, the gate electrodes in display region 16 are activated and the output terminals $Data_{(16:9)}$ provide black image data b thereto.

During period $t_8$, the gate electrodes in non-display region 10*b* are activated and the output terminals $Data_{(16:9)}$ provide no image data thereto.

The period during which a 4:3 panel displays a 16:9 image equals the period during which a 4:3 panel displays a 4:3 image. Therefore, the sum of periods $t_1$, $t_2$, $t_3$ equals the sum of periods $t_4$, $t_5$, $t_6$, $t_7$, $t_8$. Since display times of image data of 16:9 and 4:3 are the same, the period $t_2$ equals the period $t_6$.

If the sum of periods $t_4$ and $t_5$ equals period $t_1$ and the sum of periods $t_7$ and $t_8$ equals period $t_3$, as the 4:3 panel displays the 16:9 image, the controller must activate the gate electrodes in non-display region 10*a* and display region 12 during period $t_1$. As the 4:3 panel displays the 4:3 image, the controller must activate the gate electrodes in non-display region 10*a* during period $t_1$. Therefore, during period $t_1$, when the 16:9 image is displayed on the 4:3 panel, the sum of the activated gate electrodes exceeds that of the gate activated electrodes when the 4:3 image is displayed on the 4:3 panel.

Similarly, as the 4:3 panel displays the 16:9 image, the controller must activate the gate electrodes in the display region 16 and non-display region 10*b* during period $t_3$. If the 4:3 panel displays the 4:3 image, the controller must activate the gate electrodes in non-display region 10*b* during period $t_3$. Therefore, during period $t_3$, when the 16:9 image is displayed on the 4:3 panel, the number of activated gate electrodes exceeds that of the gate activated electrodes when the 4:3 image is displayed on the 4:3 panel.

Therefore, when the 16:9 image is displayed on the 4:3 panel, the controller must reduce the activation period of each gate electrode in non-display region 10*a* and display region 12 or in display region 16 and non-display region 10*b*, or increase the frequency of the vertical clock signal CKV, to activate all gate electrodes in non-display region 10*a* and display region 12 or in display region 16 and non-display region 10*b* for a fixed duration.

When the activation period of each gate electrode in display regions 12 and 14 is reduced and the panel is amorphous silicon, the store capacitors of the display units on the panel cannot store sufficient electric charges. A conventional solution increases the size of the thin film transistor (TFT) in the display units such that the aperture ratio and the brightness of panel are reduced, resulting in black image displayed in the display regions 12 and 14 having insufficient blackness.

SUMMARY

Embodiments of the invention provide a controller switching a display mode of a display panel. The display panel comprises a plurality of data electrodes and a plurality of gate electrodes. Gate electrodes are divided into at least one first, second, and third gate electrode group. The controller comprises a processor, a gate driver, and a data driver. The processor provides a first initial signal and switches the display mode of the display panel to a first display mode when a select signal is asserted. The gate driver simultaneously activates the gate electrodes in the first gate electrode group when receiving the first initial signal, sequentially activates the gate electrodes in the second gate electrode group when the first gate electrode group is activated, and simultaneously activates the gate electrodes in the third gate electrode group when the second gate electrode group is activated. The data driver provides corresponding image data to the data electrode depending on the activated gate electrodes when the first, second, or third gate electrode group is activated.

In addition, a control method is provided for a display panel comprising a plurality of data electrodes and a plurality of gate electrodes. The gate electrodes are divided into at least one first, second, and third gate electrode group. The control method determines a display mode of the display panel according to a select signal, simultaneously activating the gate electrodes in the first gate electrode group when the select signal is asserted, sequentially activating the gate electrodes in the second gate electrode group when the first gate electrode group is activated, and simultaneously activating the gate electrodes in the third gate electrode group when the second gate electrode group is activated.

In addition, a display device comprising a display panel and a controller is provided. The display panel comprises a plurality of data electrodes and a plurality of gate electrodes. Gate electrodes are divided into at least one first, second, and third electrode group. The controller switches a display model of the display panel and comprises a processor, a gate driver, and a data driver. The processor provides a first initial signal and switches the display mode of the display panel to a first display mode when a select signal is asserted. The gate driver simultaneously activates the gate electrodes in the first gate electrode group when receiving the first initial signal, sequentially activating the gate electrodes in the second gate electrode group when the first gate electrode group is activated, and simultaneously activating the gate electrodes in the second gate electrode group when the second gate electrode group is activated. The data driver provides corresponding image data to the data electrodes depending on the activated electrodes when the first, second, or third gate electrode group is activated.

BRIEF DESCRIPTION OF THE DRAWINGS

The invention can be more fully understood by reading the subsequent detailed description and examples with reference made to the accompanying drawings, wherein.

DETAILED DESCRIPTION

As a 4:3 panel displays a 16:9 image, embodiments of the invention simultaneously activate a number of gate electrodes to increase the activation period of gate electrodes to increase electric charges at storage capacitors.

Figure 3:
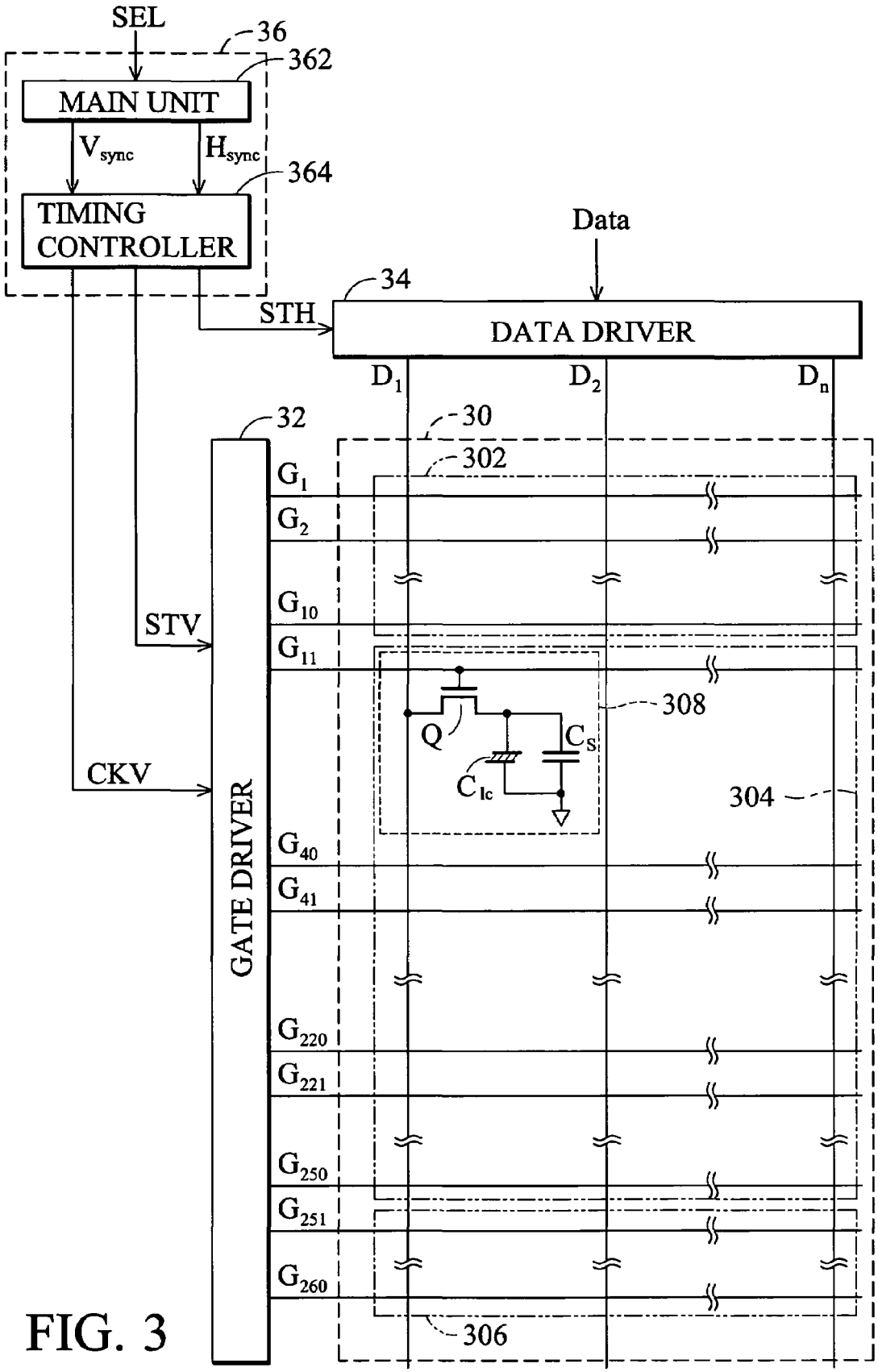
FIG. 3 is a block diagram of a liquid crystal display (LCD) according to an embodiment of the invention.

FIG. 3 is a block diagram of a liquid crystal display (LCD) according to an embodiment of the invention. The LCD comprises panel 30 having an aspect ratio of 4:3 and a controller 31 comprising gate driver 32, data driver 34, processor 36 comprising main unit 362 and timing controller 364. Panel 30 comprises data electrodes $D_1$~$D_n$ and gate electrodes $G_1$~$G_{260}$. Each interlacing data electrode and gate electrode controls a display unit. For example, interlacing data electrode $D_1$ and gate electrode $G_{11}$ control display unit 308 comprising a thin film transistor (TFT) Q, liquid crystal capacitor $C_{lc}$, and storage capacitor $C_S$.

Panel 30 comprises display region 304 and non-display regions 302 and 306. Each region comprises gate electrodes. The number of gate electrodes is not limited. In an embodiment, the number of gate electrodes is 260.

The LCD can operate in a first display mode or a second display mode, first display mode comprising the panel 30 displaying a 16:9 image and second display mode comprising the panel 30 displays a 4:3 image as an example.

Main unit 362 provides a vertical synchronizing signal (Vsyne) and a horizontal synchronizing signal (Hsyne) to timing controller 364 to drive gate driver 32 and data driver 34 according to the selected display mode.

Figure 4:
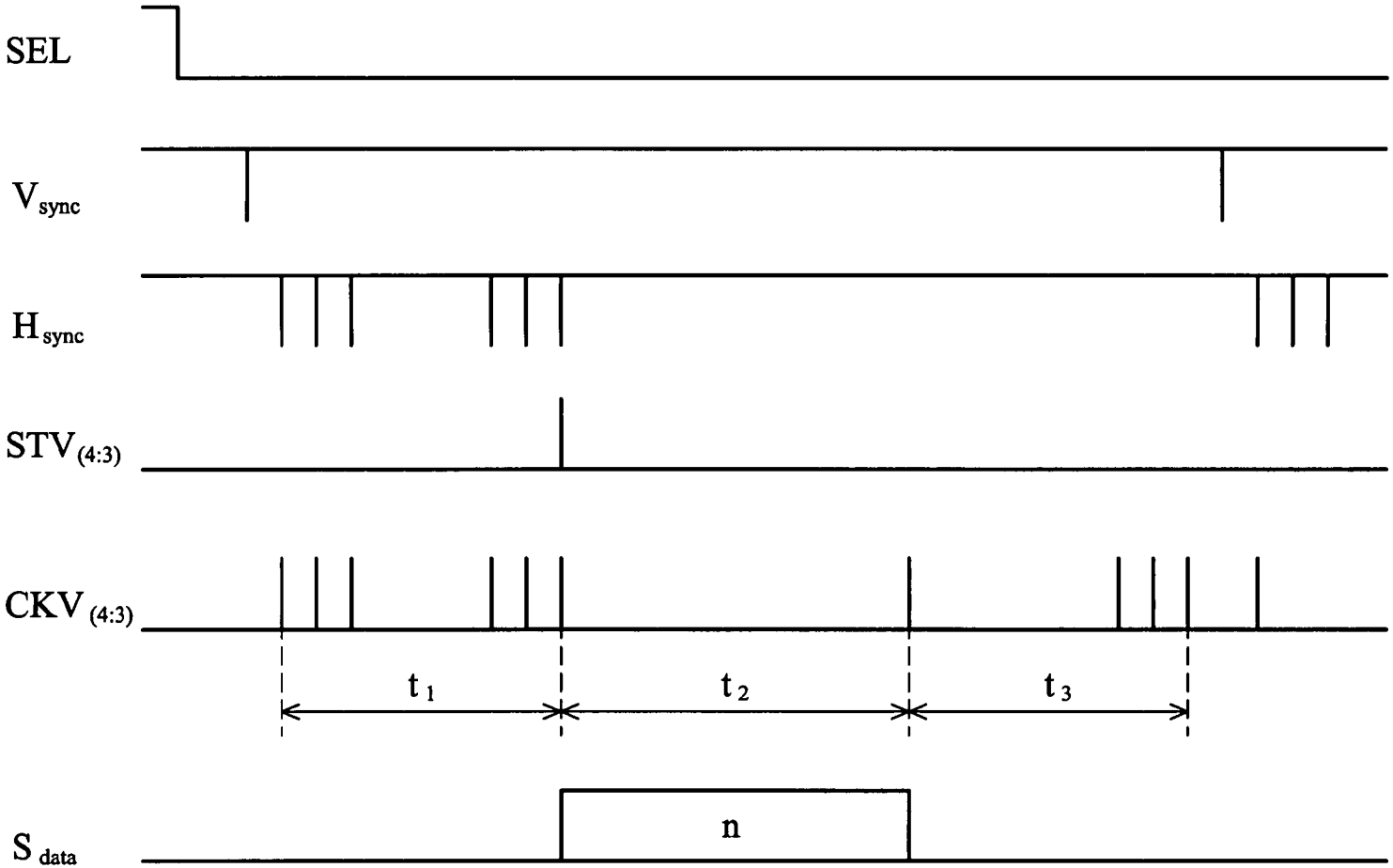
FIGS. 4 and 5 are timing charts of operation of the LCD configured as shown in FIG. 3.
Figure 5:
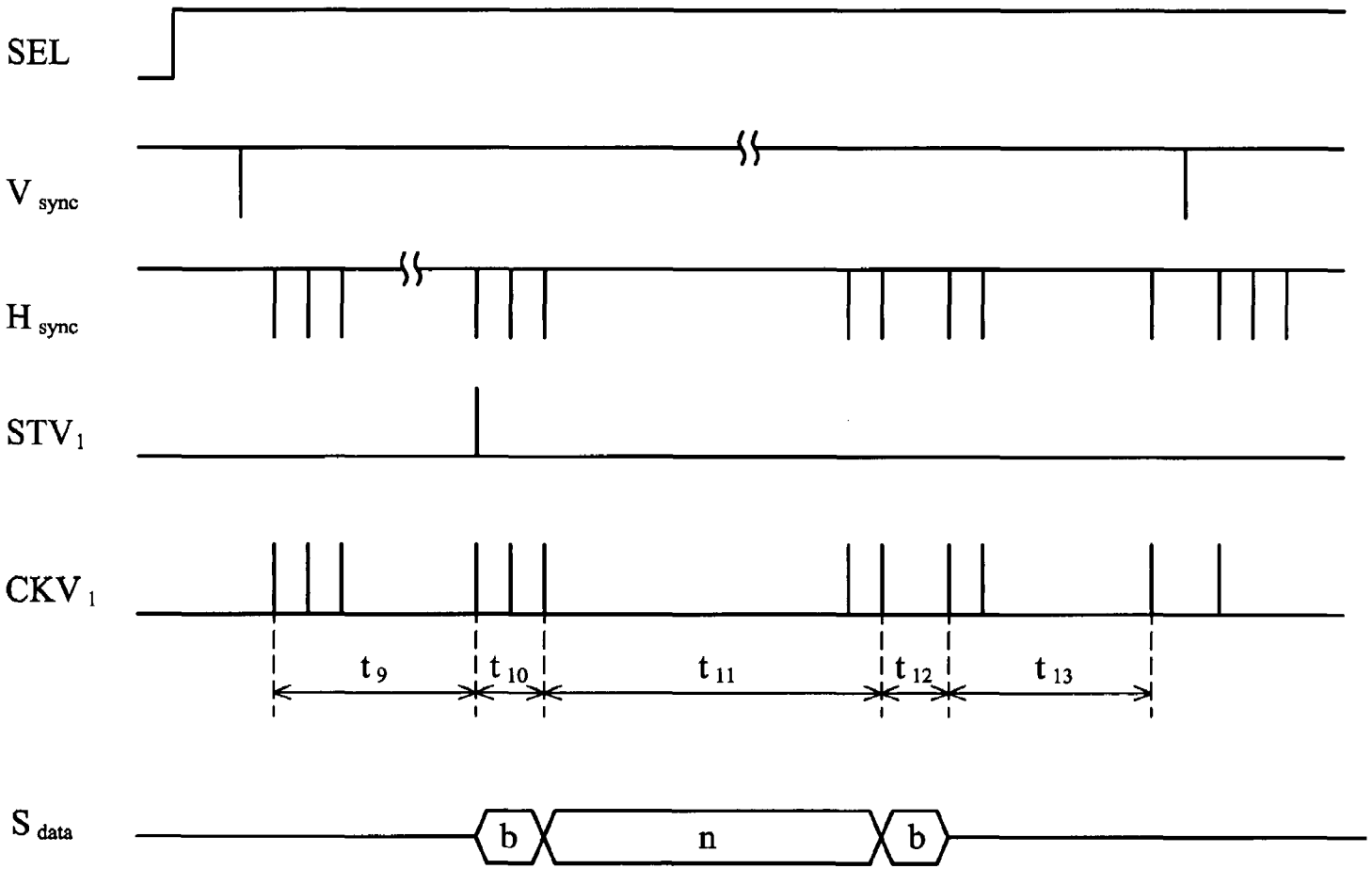

Display of a 4:3 image on panel 30 is described as follows. FIGS. 4 and 5 are timing charts illustrating the operation of the LCD configured as shown in FIG. 3. As shown in FIGS. 3 and 4, as panel 30 displays the 4:3 image, selection signal SEL is deasserted. When the deasserted selection signal SEL is detected by main unit 362, timing controller 364 outputs vertical clock signal $CKV_{(4:3)}$ to gate driver 32 to activate corresponding gate electrodes according to the Vsyne and Hsyne provided by main unit 362.

During period $t_1$, gate driver 32 sequentially activates gate electrodes $G_1$~$G_{10}$ disposed in non-display region 302. At this time, data driver 34 provides no image data $S_{data}$ to data electrodes $D_1$~$D_n$. As shown in FIG. 4, $S_{data}$ represents data of data electrodes $D_1$~$D_n$. After period $t_1$, vertical initial signal $STV_{(4:3)}$ is asserted by timing controller 364 to drive gate driver 32 to sequentially activate gate electrodes $G_{11}$~$G_{250}$ and assert a horizontal initial signal STH during period $t_2$ such that data driver 40 provides normal image data n to data electrodes $D_1$~$D_n$. During period $t_3$, gate driver 32 activates gate electrodes $G_{251}$~$G_{260}$ and data driver 34 provides no image data to data electrodes $D_1$~$D_n$.

As a 4:3 image is displayed, gate driver 32 sequentially activates gate electrodes, and each shift register (not shown) in gate driver 32 is coupled to each gate electrode.

Display a 16:9 image on a 4:3 panel is described as follows. In FIG. 3, gate electrodes $G_{11}$~$G_{40}$ are divided into first and second gate electrode groups, respectively, and gate electrodes $G_{221}$~$G_{250}$ are divided into third and fourth gate electrode groups, respectively. As shown in FIGS. 3 and 5, as panel 30 displays the 16:9 image, selection signal SEL is asserted. When the asserted selection signal SEL is detected by main unit 362, timing controller 364 outputs vertical clock signal $CKV_1$ to gate driver 32 to activate corresponding gate electrodes according to the Vsyne and Hsyne provided by main unit 362.

During period $t_9$, gate driver 32 sequentially activates gate electrodes $G_1$~$G_{10}$ disposed in non-display region 302. At this time, data driver 34 provides no image data to data electrodes $D_1$~$D_n$. In FIG. 5, $S_{data}$ represents data of data electrodes $D_1$~$D_n$. After period $t_9$, vertical initial signal $STV_1$ is asserted by timing controller 364 to drive gate driver 32 to sequentially activate the first and the second gate electrode groups and assert horizontal initial signal STH during period $t_{10}$ such that data driver 40 provides black image data b to data electrodes $D_1$~$D_n$.

Since gate electrodes $G_{11}$~$G_{40}$ are divided into first and second gate electrode groups, respectively, the activation period of each gate electrode in the first and the second gate electrode groups increases due to gate driver 32 sequentially activating the first and the second gate electrode groups. However, gate driver 32 can simultaneously activate the first and the second gate electrode groups.

After period $t_{10}$, gate driver 32 sequentially activates gate electrodes $G_{41}$~$G_{220}$ and data driver 34 provides normal image data n to data electrodes $D_1$~$D_n$ during period $t_{11}$.

During period $t_{12}$, gate driver 32 activates the third gate electrode group and activates the fourth gate electrode group and data driver 34 provides black image data b to data electrodes $D_1$~$D_n$. Gate driver 32 sequentially activates gate electrodes $G_{251}$~$G_{260}$ and data driver 34 provides no image data, during period $t_{13}$.

The 16:9 image is displayed on panel 30 when gate electrodes $G_1$~$G_{260}$ are activated. Timing controller 362 does not drive gate driver 32 and data driver 34 until next Vsyne is asserted.

Figure 1A:
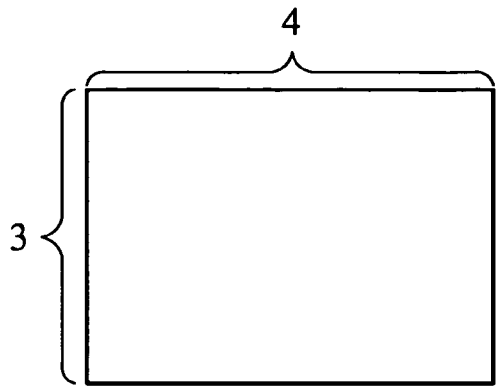
FIG. 1*a* is a schematic diagram of a conventional display panel.
Figure 1B:
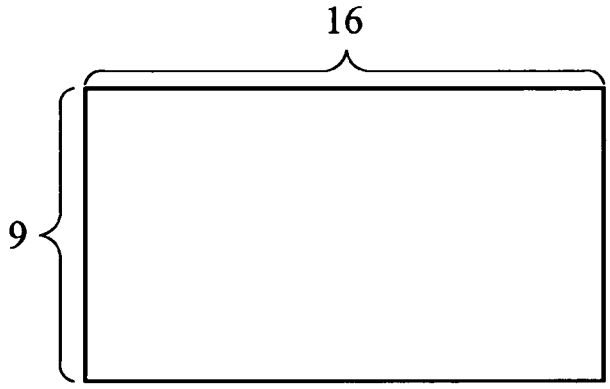
FIGS. 1*b* and 1*c* show schematic diagrams of a conventional display result.
Figure 1C:
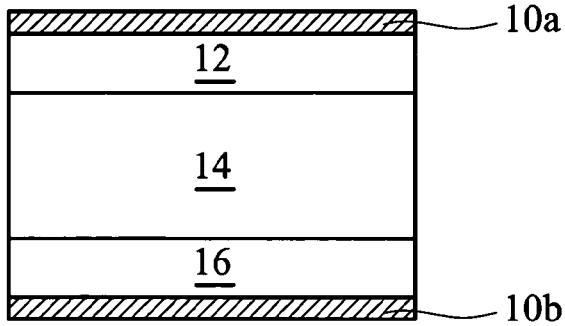
Figure 2A:
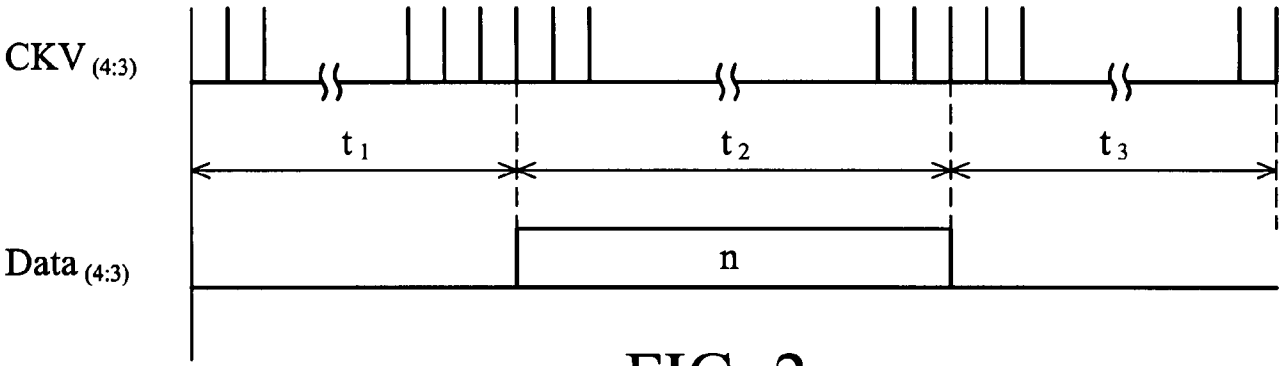
FIGS. 2*a* and 2*b* are timing charts of operation of a conventional controller.
Figure 2B:
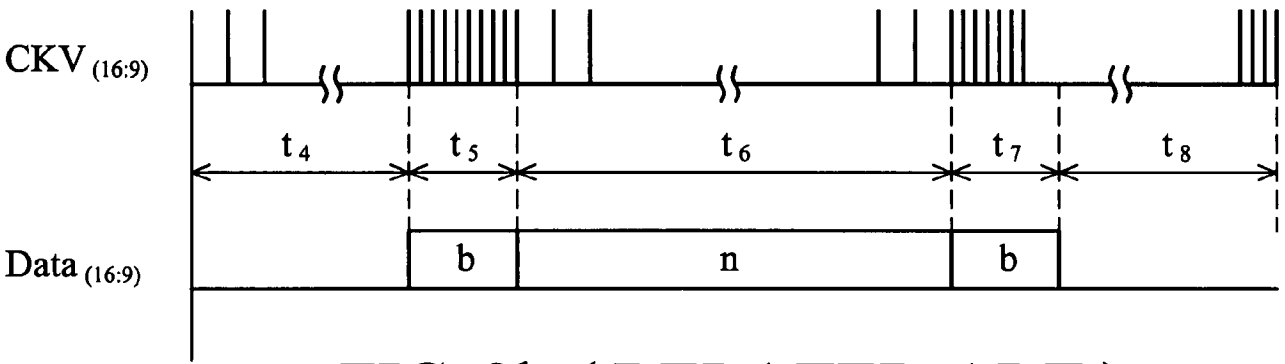
FIG. 2b ( RELATED ART )

A control method according to an embodiment of the invention is described as follows. As shown in FIG. 1*c*, non-display regions 10*a* and 10*b* respectively comprise 10 gate electrodes, display regions 12 and 16 respectively comprise 30 gate electrodes, and frequency of a vertical clock signal $CKV_{(4:3)}$ is 1 KHz, i.e. the activation period of each gate electrode is 1 ms. Since non-display regions 10*a* and 10*b* respectively have 10 gate electrodes, non-display regions 10*a* and 10*b* respectively require 10 ms to activate all gate electrodes.

Gate electrodes in display region 12 are divided into first and second gate electrode groups. Since display region 12 comprises 30 gate electrodes, each gate electrode group comprises 15 gate electrodes. As the 16:9 image is displayed on panel 30, gate driver 32 activates the first gate electrode group and activates the second gate electrode group. Therefore, gate electrodes in display region 12 can be taken as two gate electrodes. Similarly, gate electrodes in display region 16 can be taken as two gate electrodes.

As gate driver 32 requires 10 ms to activate 10 gate electrodes in non-display region 10*a* and two gate electrodes in display region 12, the activation period of each gate electrode is about 0.83 ms.

Similarly, the activation period of each gate electrode in display region 16 and non-display region 10*b* requires about 0.83 ms.

As a conventional gate driver sequentially activates 10 gate electrodes of non-display region 10*a* and 30 gate electrodes of display region 12 in 10 ms, the activation period for each gate electrodes is about 0.25 ms lower than the period of the invention.

As a 16:9 image is displayed on panel 30, gate driver 32 according the embodiment of the invention activates a gate electrode group comprising a plurality of gate electrodes. Therefore, the activation period of each gate electrode is not substantially reduced. The activation period of each gate electrode in non-display region 10*a* and display region 12 or in display region 16 and non-display region 10*b* is increased to about 0.9 ms. As the number of simultaneously activated gate electrodes activated is increased, charges of storage capacitors in display units are increased to increase brightness of display units.

Gate driver 32 can also simultaneously activate a plurality of gate electrodes in display regions 12 or 16 to reduce the activation period of each gate electrode in non-display regions 10*a* or 10*b* such that the activation period of each gate electrode in display regions 12 or 16 is maintained at 10 ms. Therefore, the brightness of display units in display regions 12 or 16 is sufficiently black. Gate driver 32 also can activate a plurality of gate electrodes in non-display regions 10*a* or 10*b* to increase the activation period of each gate electrode in non-display regions 10*a* or 10*b*.

The invention does not limit the number of gate electrode groups such that the number of gate electrode groups in display regions 12 differs from the number of gate electrode groups in display regions 16.

Generally, gate driver 32 and data driver 34 may comprise shift register circuits formed by a plurality of shift register units. Output terminals of each shift register unit are coupled to the corresponding gate or data electrodes to activate the corresponding gate or data electrodes.

According to an embodiment of the invention, gate driver 32 simultaneously activates many gate electrodes when the display panel with aspect ratio of 4:3 displays the 16:9 image. Thus, the activated gate electrodes are coupled to the same shift register unit to be selected simultaneously. If gate driver 32 simultaneously activates gate electrodes $G_{11}$~$G_{25}$ and simultaneously activates gate electrodes $G_{26}$~$G_{40}$, gate electrodes $G_{11}$~$G_{25}$ are coupled to a shift register unit and gate electrodes $G_{26}$~$G_{40}$ are coupled to the next stage shift register unit.

As a 4:3 image is displayed on panel 30 with aspect ratio of 4:3, gate electrodes are sequentially activated such that gate electrodes are coupled to shift register units, respectively. Since gate driver 32 switches display modes of panel 30 according to the logic level of the selection signal SEL, the connections between gate electrode and the shift register unit can also be determined according to the logic level of the selection signal SEL. A plurality of gate electrodes are selectively coupled to the single shift register unit through switches or other devices. The method for switching between the shift register unit and the gate electrode is well known to those skilled in the art.

Additionally, the period for asserting the vertical initial signal by timing controller 364 is changed according to the selected display mode. In this embodiment, as a 4:3 image is displayed on panel 30, timing controller 364 outputs vertical initial signal $STV_{(4:3)}$ in a first preset time and as a 16:9 image is displayed on a 4:3 panel, timing controller 364 outputs vertical initial signal $STV_1$ in a second preset time less than the first preset time.

Figure 6:
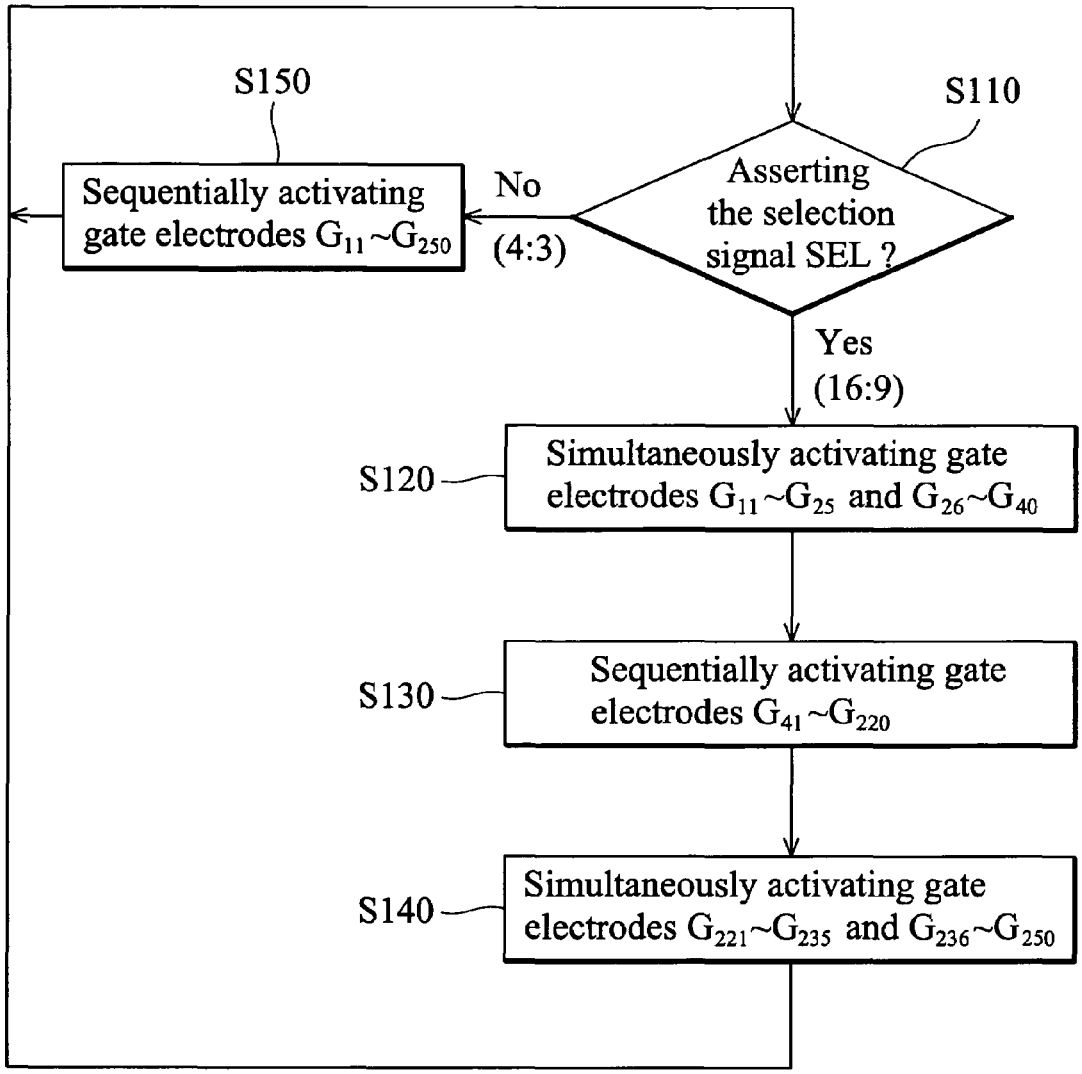
FIG. 6 is a flowchart of a control method according to an embodiment of the invention.

FIG. 6 is a flowchart of a control method according to an embodiment of the invention. Referring to FIG. 3, the operation of the control method controlling gate electrodes in display region 304 is described as follows.

The state of selection signal SEL is detected to obtain the selected display mode by a user in step S110. To display a 16:9 image on panel 30, selection signal SEL is asserted by processor 36. In this embodiment, gate driver 32 simultaneously activates gate electrodes $G_{11}$~$G_{25}$ and then simultaneously activates gate electrodes $G_{26}$~$G_{40}$.

After gate electrodes $G_{11}$~$G_{40}$ are activated, gate driver 32 sequentially activates gate electrodes $G_{41}$~$G_{220}$ in step S130 and data driver 34 provides normal image data to data electrodes $D_1$~$D_n$.

Gate driver 32 simultaneously activates gate electrodes $G_{221}$~$G_{235}$ and simultaneously activates gate electrodes $G_{236}$~$G_{250}$ in step S140. In this embodiment, gate electrodes $G_{11}$~$G_{40}$ and $G_{221}$~$G_{250}$ are divided into two gate electrode groups, respectively. However gate electrodes $G_{11}$~$G_{40}$ can be divided into two gate electrode groups and gate electrodes $G_{221}$~$G_{250}$ are divided into three gate electrode groups.

To display a 4:3 image in panel 30, selection signal SEL is deasserted such that gate driver 32 sequentially activates gate electrodes $G_{11}$~$G_{250}$ in step S150 and then data driver 34 provides normal image data to data electrodes $D_1$~$D_n$.

Embodiments of the invention simultaneously activate many gate electrodes in non-display or display regions such that the activation period of each gate electrode in non-display or display regions is increased. Therefore, brightness of the panel is increased. Additionally, the invention does not limit the number of the activated gate electrodes such that the elasticity of a design circuit is higher.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A controller switching a display mode of a display panel, the display panel comprising a plurality of data electrodes and a plurality of gate electrodes divided into at least one first, second, and third gate electrode group, comprising:

a processor providing a first initial signal and switching the display mode of the display panel to a first display mode when a select signal is asserted, wherein the processor provides a second initial signal to switch the display mode of the display panel to a second mode when the select signal is deasserted;

a gate driver simultaneously activating the gate electrodes in the first gate electrode group when receiving the first initial signal, sequentially activating the gate electrodes in the second gate electrode group when the first gate electrode group is activated, and simultaneously activating the gate electrodes in the third gate electrode group when the second gate electrode group is activated; and a data driver providing corresponding image data to the data electrode depending on the activated gate electrodes when the first, second, or third gate electrode group is activated, wherein the gate driver sequentially activates the gate electrodes in the first gate electrode group when receiving the second initial signal, the gate driver sequentially activates the gate electrodes in the second gate electrode group when the first gate electrode group is activated, and the gate driver sequentially activates the gate electrodes in the third gate electrode group when the second gate electrode group is activated.

2. The controller as claimed in claim 1, wherein the gate driver simultaneously activates the first gate electrode groups when the gate electrodes are divided into at least two first gate electrode groups.

3. The controller as claimed in claim 1, wherein the gate driver sequentially activates the first gate electrode groups when the gate electrodes are divided into at least two first gate electrode groups.

4. The controller as claimed in claim 1, wherein the gate driver simultaneously activates the third gate electrode groups when the gate electrodes are divided into at least two third gate electrode groups.

5. The controller as claimed in claim 1, wherein the gate driver sequentially activates the third gate electrode groups when the gate electrodes are divided into at least two third gate electrode groups.

6. The controller as claimed in claim 1, wherein the processor provides the first initial signal during a first preset time when the select signal is asserted, and the processor provides the second initial signal during a second preset time less than the first preset time when the select signal is deasserted.

7. The controller as claimed in claim 6, wherein the processor comprises a timing controller determining the first preset time and second preset time according to a vertical synchronizing signal and a horizontal synchronizing signal.

8. A display device, comprising:

a display panel comprising a plurality of data electrodes and a plurality of gate electrodes, wherein the gate electrodes are divided into at least one first, second, and third gate electrode group; and a controller switching a display model of the display panel and comprising:

a processor providing a first initial signal and switching the display mode of the display panel to a first display mode when a select signal is asserted, wherein the processor provides a second initial signal switch the display mode of the display panel to a second mode when the select signal is deasserted;

a gate driver simultaneously activating the gate electrodes in the first gate electrode group when receiving the first initial signal, sequentially activating the gate electrodes in the second gate electrode group when the first gate electrode group is activated, and simultaneously activating the gate electrodes in the third gate electrode group when the second gate electrode group is activated; and a data driver providing corresponding image data to the data electrodes depending on the activated gate electrodes when the first, second, or third gate electrode group is activated, wherein the gate driver sequentially activates the gate electrodes in the first gate electrode group when receiving the second initial signal, the gate driver sequentially activates the gate electrodes in the second gate electrode group when the first gate electrode group is activated, and the gate driver sequentially activates the gate electrodes in the third gate electrode group when the second gate electrode group is activated.

9. The display device as claimed in claim 8, wherein the gate driver simultaneously activates the first gate electrode groups when the gate electrodes are divided into at least two first gate electrode groups.

10. The display device as claimed in claim 8, wherein the gate driver sequentially activates the first gate electrode groups when the gate electrodes are divided into at least two first gate electrode groups.

11. The display device as claimed in claim 8, wherein the gate driver simultaneously activates the third gate electrode groups when the gate electrodes are divided into at least two third gate electrode groups.

12. The display device as claimed in claim 8, wherein the gate driver sequentially activates the third gate electrode groups when the gate electrodes are divided into at least two third gate electrode groups.

13. The display device as claimed in claim 8, wherein the processor provides the first initial signal during a first preset time when the select signal is asserted, and the processor provides the second initial signal during a second preset time less than the first preset time when the select signal is deasserted.

14. The display device as claimed in claim 13, wherein the processor comprises a timing controller determining the first preset time and second preset time according to a vertical synchronizing signal and a horizontal synchronizing signal.

* * * * *